US008421327B2

(12) United States Patent
Wei et al.

(10) Patent No.: US 8,421,327 B2
(45) **Date of Patent: *Apr. 16, 2013**

(54) EMITTER HAVING CARBON NANOTUBES

(75) Inventors: Yang Wei, Beijing (CN); Peng Liu, Beijing (CN); Liang Liu, Beijing (CN); Shou-Shan Fan, Beijing (CN)

(73) Assignees: Tsingua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 147 days.

This patent is subject to a terminal disclaimer.

(21) Appl. No.: 12/384,243

(22) Filed: Apr. 2, 2009

(65) Prior Publication Data

US 2009/0309478 A1 Dec. 17, 2009

(30) Foreign Application Priority Data

Jun. 13, 2008 (CN) ..... 2008 1 0067726

(51) Int. Cl.
*H01J 1/02* (2006.01)
*H01J 1/62* (2006.01)
*H01J 1/304* (2006.01)

(52) U.S. Cl.
USPC ..... 313/311; 313/310; 313/336; 313/351; 313/309

(58) Field of Classification Search ..... 313/309, 313/310, 311, 495
See application file for complete search history.

(56) References Cited

U.S. PATENT DOCUMENTS

| | | | | |
|---|---|---|---|---|
| 6,239,547 | B1 * | 5/2001 | Uemura et al. | 313/495 |
| 6,297,592 | B1 * | 10/2001 | Goren et al. | 315/3.5 |
| 6,864,162 | B2 * | 3/2005 | Jin | 438/551 |
| 6,911,767 | B2 * | 6/2005 | Takai | 313/311 |
| 7,086,451 | B2 * | 8/2006 | Leu et al. | 165/80.3 |
| 7,394,192 | B2 * | 7/2008 | Kurachi et al. | 313/495 |
| 7,932,477 | B2 * | 4/2011 | Wei et al. | 219/121.27 |
| 7,988,515 | B2 * | 8/2011 | Wei et al. | 445/50 |
| 8,013,505 | B2 * | 9/2011 | Wei et al. | 313/311 |
| 8,089,206 | B2 * | 1/2012 | Wei et al. | 313/497 |
| 2002/0067114 | A1 | 6/2002 | Choi et al. | |
| 2002/0175618 | A1 * | 11/2002 | Lee et al. | 313/495 |
| 2004/0095050 | A1 * | 5/2004 | Liu et al. | 313/309 |
| 2005/0040090 | A1 * | 2/2005 | Wang et al. | 210/184 |
| 2006/0079012 | A1 | 4/2006 | Jeong et al. | |
| 2008/0122335 | A1 | 5/2008 | Liu et al. | |

FOREIGN PATENT DOCUMENTS

| | | | |
|---|---|---|---|
| CN | 1433039 | A | 7/2003 |
| CN | 1501422 | | 6/2004 |
| CN | 101192490 | A | 6/2008 |

* cited by examiner

*Primary Examiner* — Sikha Roy
(74) *Attorney, Agent, or Firm* — Altis Law Group, Inc.

(57) ABSTRACT

An emitter includes an electrode, and a number of carbon nanotubes fixed on the electrode. The carbon nanotubes each have a first end and a second end. The first end is electrically connected to the substrate and the second end has a needle-shaped tip. Two second ends of carbon nanotubes have a larger distance therebetween than that of the first ends thereof, which is advantageous for a better screening affection. Moreover, the needle-shaped tip of the second ends of the carbon nanotube has a lower size and higher aspect ratio than the conventional carbon nanotube, which, therefore, is attributed to bear a larger emission current.

8 Claims, 9 Drawing Sheets

EMITTER HAVING CARBON NANOTUBES

This application is related to commonly-assigned applications entitled, "FIELD EMISSION CATHODE AND FIELD EMISSION DISPLAY EMPLOYING WITH SAME", filed on Apr. 2, 2009, (application Ser. No. 12/384,232). The disclosure of the above-identified application is incorporated herein by reference.

BACKGROUND

1. Technical Field

The present disclosure relates to an emitter and, in particular, to an emitter employed with the carbon nanotubes and a method for manufacturing the same.

2. Description of the Related Art

Carbon nanotubes (CNTs) are widely used as field emitters for field emission displays (FEDs) and liquid crystal displays (LCDs). Such CNTs have good electron emission characteristics, and chemical and mechanical durability.

Conventional field emitters are typically micro tips made of a metal such as molybdenum (Mo). However, the life span of such a micro tip is shortened due to effects of atmospheric environment, such as non-uniform electric field, and the like. A somewhat viable alternative has been carbon nanotubes having a high aspect ratio, high durability, and high conductivity preferably adopted as field emitters.

In order to obtain a high current density from carbon nanotube emitters, carbon nanotubes must be uniformly distributed and arranged perpendicular to a substrate. The carbon nanotube emitters are generally grown from a substrate using a chemical vapor deposition (CVD). However, the carbon nanotubes formed by this process may be entangled with each other on the top thereof, which result in a poor morphology of CNTs and poor performance on emitting. Alternatively, the carbon nanotube emitters may also be manufactured by printing a paste obtained by combining carbon nanotubes with a resin to a substrate. This method is easier and less costly than CVD and thus preferred to CVD. However, the carbon nanotubes formed by this process are too dense to emit electrons effectively because of the strong screening effect generated between adjacent carbon nanotubes.

What is needed, therefore, is a carbon nanotube emitter and a method for manufacturing the same that can overcome the above-described shortcomings.

BRIEF DESCRIPTION OF THE DRAWINGS

The present emitter and method for manufacturing the same are described in detail hereinafter, by way of example and description of an exemplary embodiment and with references to the accompanying drawings, in which.

DETAILED DESCRIPTION

A detailed explanation of an emitter and method for manufacturing the same according to an exemplary embodiment will now be made with references to the drawings attached hereto.

Figure 1:
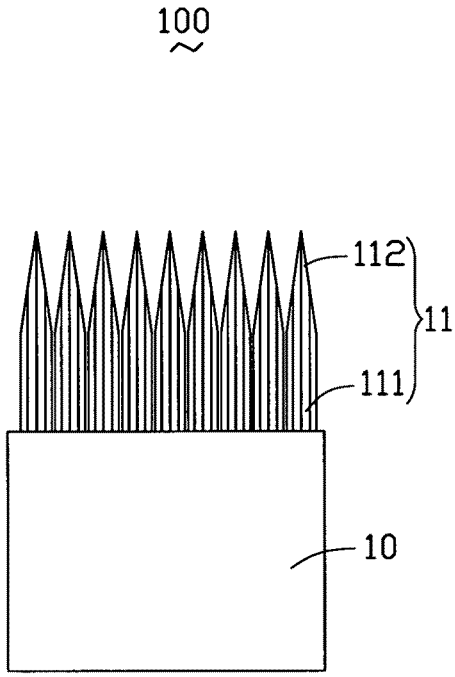
FIG. 1 is a schematic view of an emitter provided with a number of carbon nanotubes each having a needle-shaped tip according to an exemplary embodiment.
Figure 2:
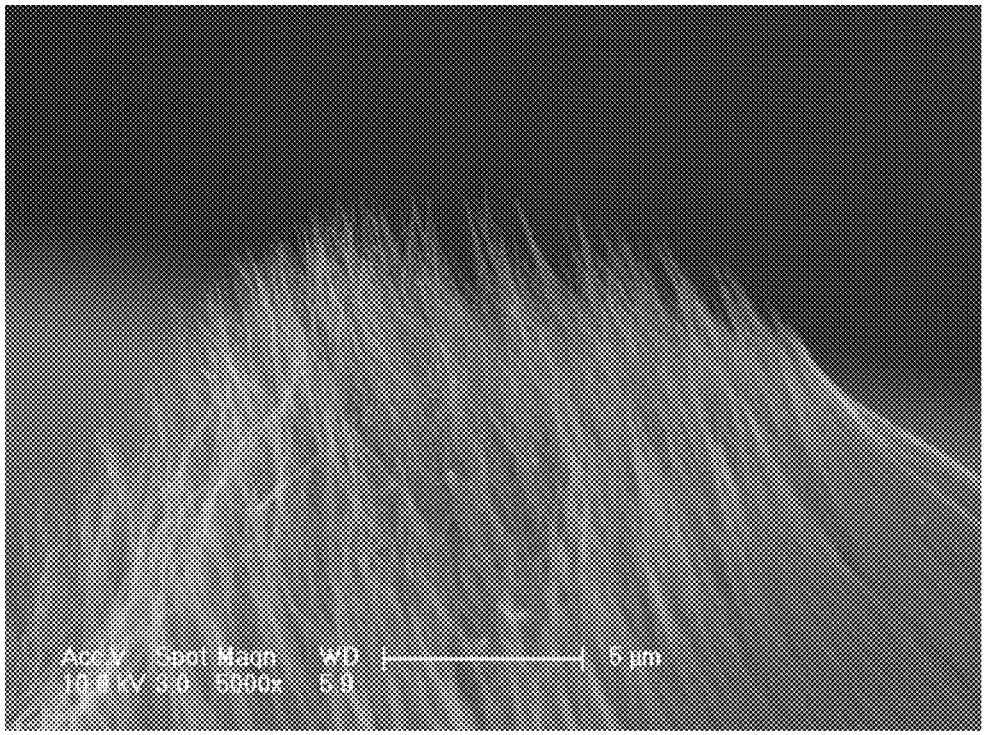
FIG. 2 is a scanning electron microscope (SEM) image of the carbon nanotubes of FIG. 1.
Figure 3:
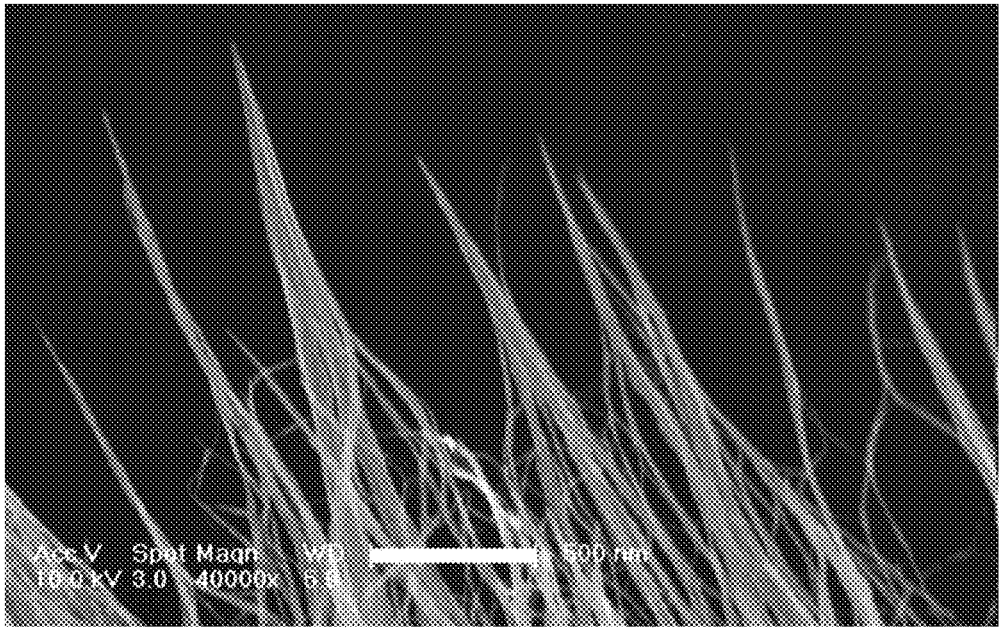
FIG. 3 is a scanning electron microscope (SEM) image of the needle-shaped tip of the carbon nanotubes of FIG. 1.

Referring to FIGS. 1-3, an emitter 100 according to the present embodiment is shown. The emitter 100 includes a substrate 10, and a number of carbon nanotubes 11 disposed on the substrate 10.

The substrate 10 may be an electrode made of copper, tungsten, aurum, gold, molybdenum, platinum, ITO glass, and combinations thereof. Alternatively, the substrate 10 may be an insulating substrate, such as a silicon sheet, coated with a metal film with a predetermined thickness. The metal film maybe one of an aluminum (Al) film, silver (Ag) film or the like. In the present embodiment, the substrate 10 is a silicon sheet coated with an Al film and configured for supporting and electrically connecting to the carbon nanotubes 11 and may function as a cathode of a field emission display (FED) (not shown). If necessary, a gate insulating layer and a gate electrode may be optionally formed on the conductive substrate 10.

Figure 7:
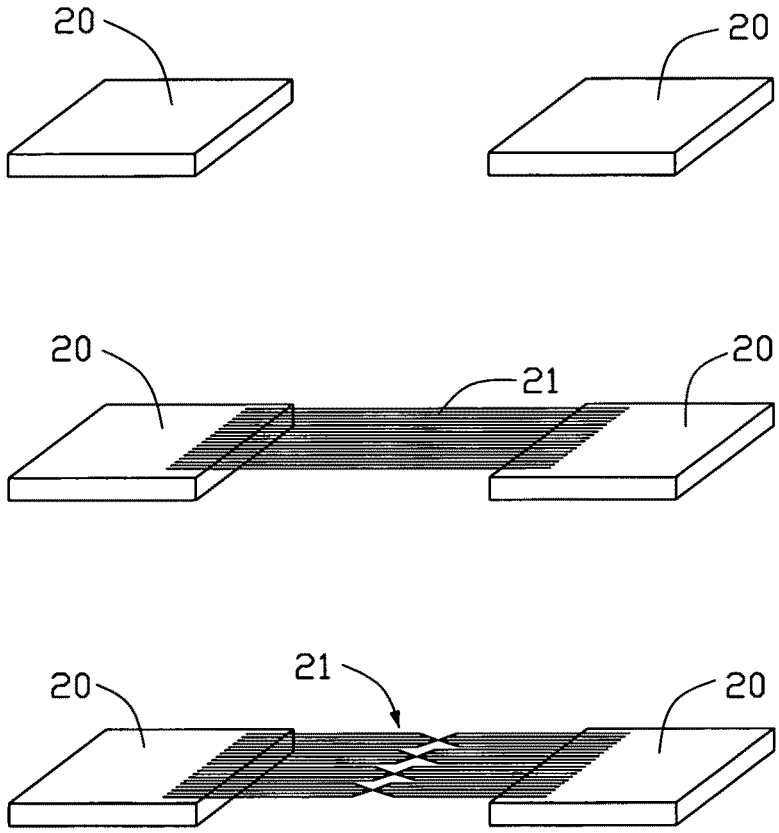
FIG. 7 is a schematic view of the manufactured emitter in steps of FIG. 6.

The carbon nanotubes 11 may be conductive single-walled carbon nanotubes (SWCNT), double-walled carbon nanotubes (DWCNT), or multi-walled carbon nanotubes (MWCNT), or their mixture. The carbon nanotubes 11 are parallel to each other. Each of the carbon nanotubes 11 has the approximately same length and includes a first end 111 and a second end 112 opposite to the first end 111. The first end 111 is electrically connected to the conductive substrate 10 by van der Waals Force. For enhancing a fastening force between the first end 111 and the conductive substrate 10, the first end 111 can be connected to the conductive substrate 10 via a conductive adhesive or by metal-bonding. The second end 112 extends away from the conductive substrate 10 and has a needle-shaped tip (not labeled). The needle-shaped tip is employed as an electron emitting source of the carbon nanotube emitter 100 for emitting electrons. The carbon nanotubes 11 each may have a diameter in a range from about 0.5 nm to about 50 nm and a length in a range about 100 μm to about 1 mm. The distance between the second ends 112 of the two adjacent carbon nanotubes 11 ranges from about 50 nm to about 500 nm. In the present embodiment, the carbon nanotubes 11 are SWCNTs having a diameter of about 1 nm and a length of about 150 mm. As shown in FIG. 1 and FIG. 7, two adjacent second ends 112 of carbon nanotubes 11 are spaced from each other by a distance greater than that between the first ends 111, thereby diminishing influence from the screening effect between the adjacent carbon nanotubes. In some embodiments, the second ends 112 of carbon nanotubes 11 form a plurality of taper-shaped carbon nanotube emitting peaks (not labeled). In each of the plurality of taper-shaped carbon nanotube emitting peaks, at least one projecting carbon nanotube is taller than and projects over other carbon nanotubes, and the other carbon nanotubes are located about the at least one projecting carbon nanotube.

Figure 4:
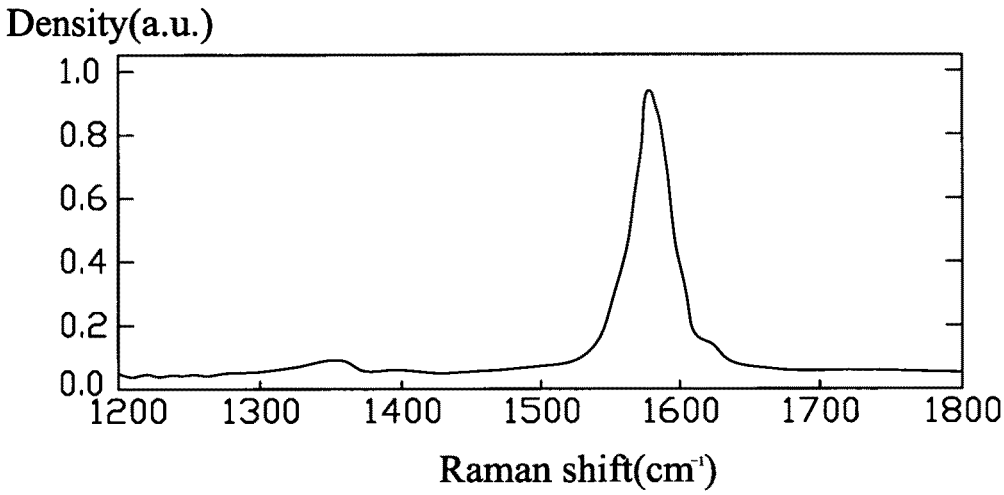
FIG. 4 is a Raman spectrum view of the emitter of FIG. 1.
Figure 5:
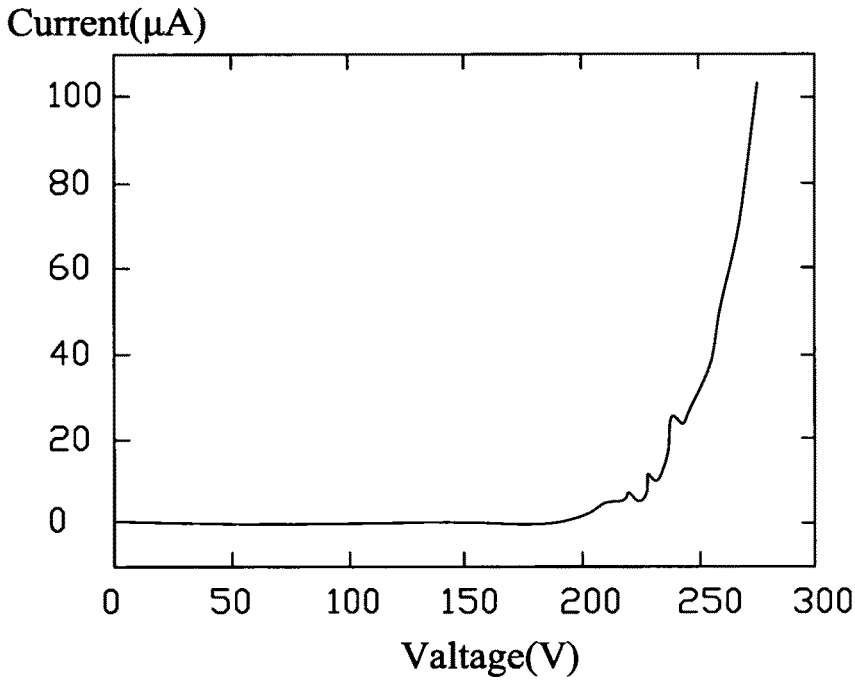
FIG. 5 is a voltage-current graph showing the electron emission characteristic of the emitter of FIG. 1.

Referring to FIGS. 4-5, in use, when the emitter 100 of the present embodiment is employed in the FED, the second end 112 can emit electrons when a low voltage is applied to the FED, because of the good electron emission characteristics of the needle-shaped tips. In the present embodiment, the emitter 100 starts to emit electrons when the applied voltage is about 200V or more. Understandably, as the applied voltage is increased, the current density increases accordingly. As shown in FIG. 4, defect analysis in Raman spectrum for the field emission affect of the carbon nanotubes 11 is shown. It can be seen that the carbon nanotubes 11 of the present embodiment have a lower defect peak than typical carbon nanotube. Therefore, it is possible to provide better field emission effect for the FED as desired.

Figure 6:
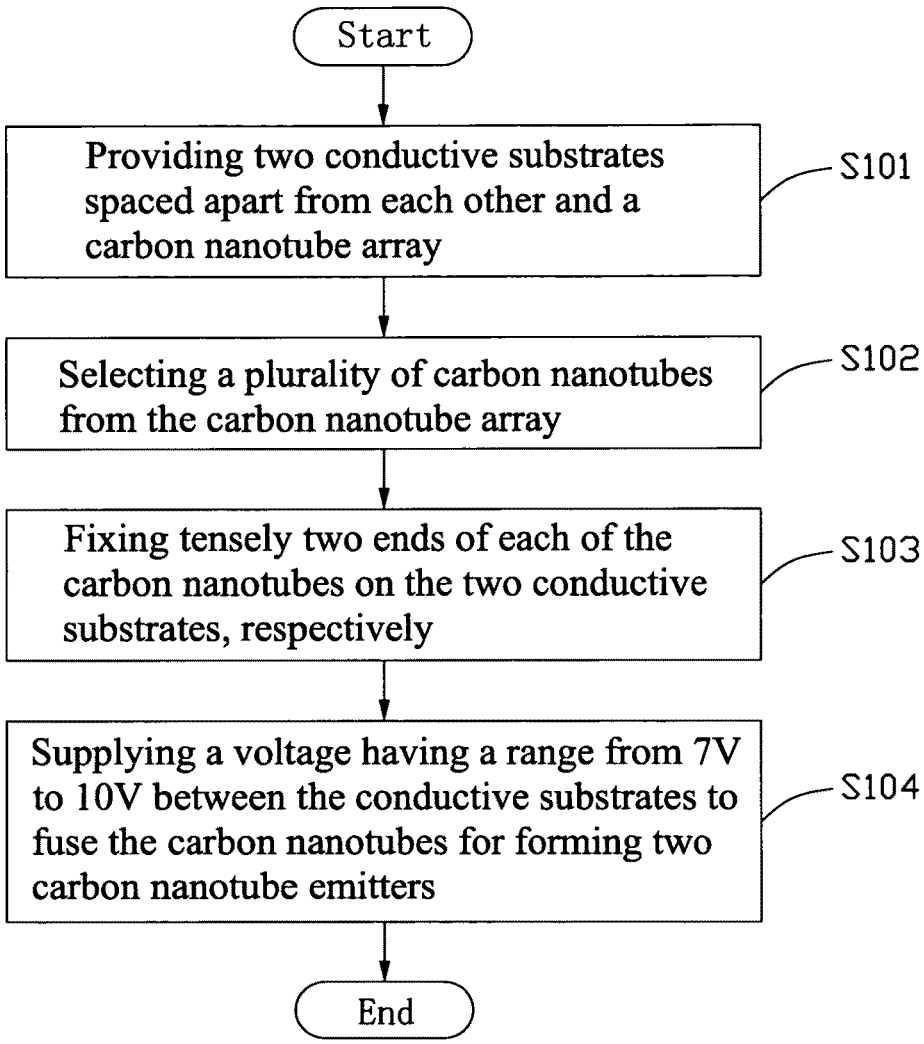
FIG. 6 is a flow chart of steps for manufacturing the emitter of FIG. 1.

Referring to FIG. 6 and FIG. 7, a flow chart of an exemplary method for manufacturing the above-described emitter 100 is shown. The method includes:

step S101: providing two conductive substrates 20 spaced apart from each other and a carbon nanotube array (not shown);

step S102: selecting one or more carbon nanotubes 21 from the carbon nanotube array;

step S103: fixing each end of the one or more carbon nanotubes 21 on one of the two conductive substrates 20; and step S104: supplying a voltage sufficient to break the one or more carbon nanotubes 21 for forming two emitters 100.

Figure 8:
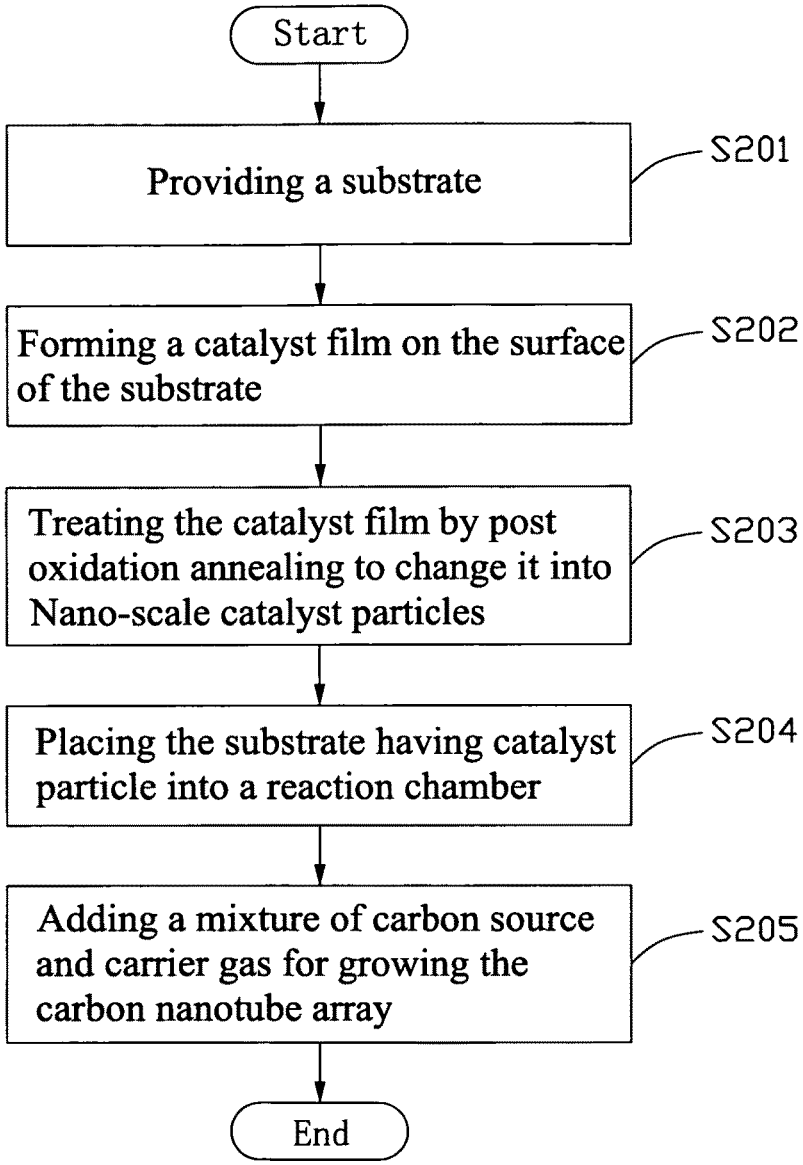
FIG. 8 is a flow chart of steps for growing a carbon nanotube array on a substrate.

In step S101, the carbon nanotube array may be acquired by the following method. The method may employ chemical vapor deposition (CVD), Arc-Evaporation Method, or Laser Ablation, but not limited to those method. In the present embodiment, the method employs high temperature CVD. Referring also to FIG. 8, the method includes:

step S201: providing a substrate;

step S202: forming a catalyst film on the surface of the substrate;

step S203: treating the catalyst film by post oxidation annealing to change it into nano-scale catalyst particles;

step S204: placing the substrate having catalyst particles into a reaction chamber; and step S205: adding a mixture of a carbon source and a carrier gas for growing the carbon nanotube array.

In step S201, the substrate maybe a silicon wafer or a silicon wafer coated with a silicon oxide film on the surface thereof. In one embodiment, the silicon wafer has flatness less than 1 μm, for providing flat for the formed carbon nanotube array.

In step S203, the catalyst film may have a thickness in a range from about 1 nm to about 900 nm and the catalyst material may be selected from a group consisting of Fe, Co, Ni, or the like.

In step S203, the treatment is carried out at temperatures ranging form about 500° C. to about 700° C. for anywhere from about 5 hours to about 15 hours.

In step S204, the reaction chamber is heated up to about 500° C. to about 700° C. and filled with protective gas, such as inert gas or nitrogen for maintaining purity of the carbon nanotube array.

In step S205, the carbon source may be selected from acetylene, ethylene or the like, and have a velocity of about 20 sccm (Standard Cubic Centimeter per Minute) to about 50 sccm. The carrier gas may select from insert gas or nitrogen, and have a velocity of about 200 sccm to about 500 sccm.

In step S102, the two conductive substrates 20 are spaced apart from each other to apply tension to the carbon nanotubes 21 selected from the carbon nanotube array. The distance between the two conductive substrates 20 is limited by the length of the carbon nanotubes.

Figure 9:
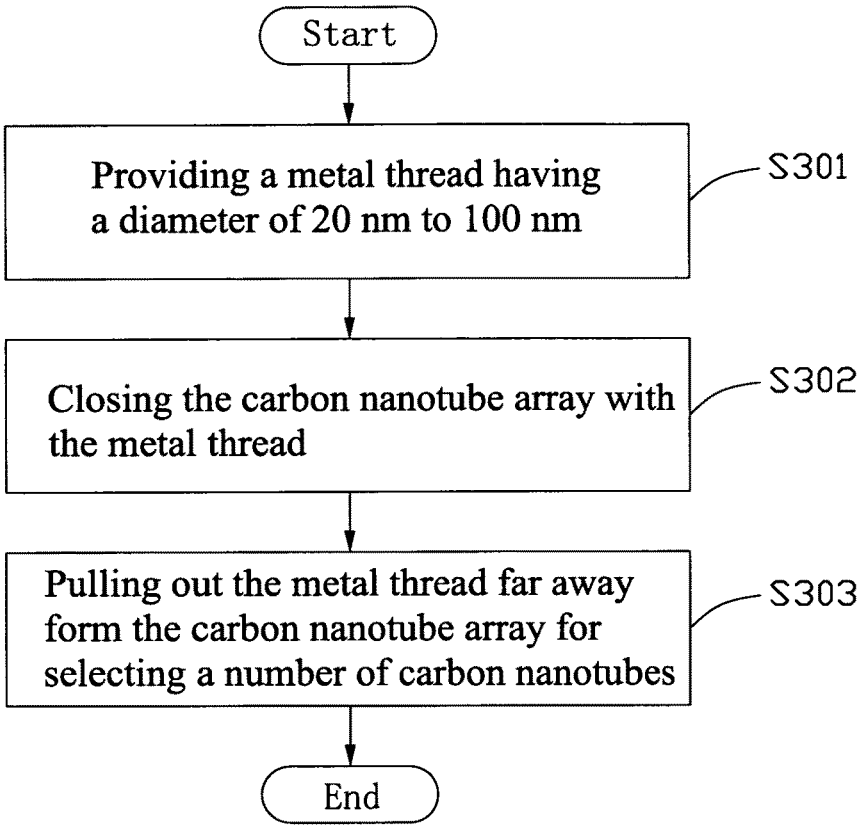
FIG. 9 is a flow chart of steps for selecting a number of carbon nanotubes from the carbon nanotube array of FIG. 8.

In step S103, the number of carbon nanotubes 21 are selected and drawn out form the carbon nanotube array provided in step S101 and opposite ends of the carbon nanotubes 21 are fixed onto the two conductive substrates 20, respectively. Referring to FIG. 9, the method for selecting the carbon nanotubes 21 includes;

step S301: providing a metal thread having a diameter of about 20 nm to about 100 nm;

step S302: bringing the metal thread towards the carbon nanotube array and contacting the carbon nanotube array;

step S303: pulling out the metal thread away from the carbon nanotube array for obtaining a number of carbon nanotubes 21.

In described method above, the metal may be selected from the following materials: copper, silver, and gold, or an alloy thereof. In the step S302, because of the strong molecular force between the carbon nanotube and the metal thread, some carbon nanotubes 21 can be adsorbed onto the metal thread. In step S303, a single segment of carbon nanotubes 21 is acquired. In the present embodiment, the acquired carbon nanotubes 21 have a length of about 2 μm to about 200 μm.

In step S104, the two conductive substrates 20 and the carbon nanotubes 21 are placing into a reaction chamber (not shown) for ensuring purity of the obtained carbon nanotubes 21 before supplying the voltage on the carbon nanotubes. The reaction chamber may be a vacuum chamber having pressure intensity less than 1×10−1 Pa or is filled with inert gas or nitrogen to prevent the carbon nanotubes 21 from oxidizing during breaking. In the present embodiment, the reaction chamber is a vacuum chamber having a pressure intensity of $2\times10^{-5}$ Pa. As well known in the art, the voltage applied between the two conductive substrates 20 is determined according to the dimension of the carbon nanotubes 21. The supplied voltage may have a range from about 7V to about 10V. In the present embodiment, the applied voltage is 8.25V. When the current flows through the carbon nanotubes 21, heat, known as joule heat, can be generated. The joule heat can break the carbon nanotubes 21. After breaking, the current is turned off and the joule heat disappears quickly, thus annealing the formed carbon nanotubes 11. The anneal, which is advantageous for improving mechanical strength of the carbon nanotubes 11, can be carried out in a vacuum chamber for preventing the carbon nanotubes 11 from oxidizing. Thus, two emitters 100 are obtained. The obtained emitters 100 have an approximately as many second ends 112 each having a needle-shaped tip as there are carbon nanotubes.

The described method above for manufacturing the carbon nanotubes 11 of the emitter 100 can prevent pollutant entering the carbon nanotubes 11 as the second ends 112 are closed and have a substantially uniform length, which can provide substantially uniform electron emitting characteristics. Moreover, the second ends 112 of the two adjacent carbon nanotubes 11 are spaced from each other by a distance greater than that of the first ends 111, thereby diminishing influence from the screening effect between adjacent carbon nanotubes.

It is to be understood that the above-described embodiments are intended to illustrates, rather than limit the invention. Variations may be made to the embodiments without departing from the spirit of the invention as claimed. The above-described embodiments illustrate the scope of the invention but do not restrict the scope of the invention.

It is to be understood that the above description and the claims drawn to a method may include some indication in reference to certain steps. However, the indication used is only to be viewed for identification purposes and not as a suggestion as to an order for the steps.

What is claimed is:

1. An emitter, comprising:

an electrode; and a carbon nanotube segment fixed on the electrode, the carbon nanotube segment comprising a first end and a second end, the first end being electrically connected to the electrode and the second end comprising a plurality of taper-shaped carbon nanotube peaks protruding out of the electrode, each of the plurality of carbon nanotube peaks comprises a plurality of carbon nanotubes, wherein a distance between adjacent two of the plurality of carbon nanotube peaks is in a range from about 50 nm to about 500 nm.

2. The emitter as claimed in claim 1, wherein at least one projecting carbon nanotube is taller than and projects over other carbon nanotubes in each of the plurality of taper-shaped carbon nanotube peaks.

3. The emitter as claimed in claim 2, wherein within each of the plurality of carbon nanotube peaks, the other carbon nanotubes are surrounds the at least one projecting carbon nanotube.

4. The emitter as claimed in claim 1, wherein the carbon nanotube segment comprises a plurality of carbon nanotubes, the plurality of carbon nanotubes are arranged in a plane and parallel to each other.

5. The emitter as claimed in claim 1, wherein adjacent two of the second ends of the plurality of carbon nanotubes are spaced from each other by a distance greater than a distance between corresponding two of the first ends.

6. An emitter, comprising:

a conductive substrate; and a carbon nanotube array comprising a plurality of carbon nanotube segments, each of the plurality of carbon nanotube segments comprising a first portion and a second portion connecting with the first portion, wherein the first portion is electrically connected to the conductive substrate, the second portion forms a taper-shaped emitting peak protruding out of the conductive substrate, a distance between adjacent two of the taper-shaped emitting peaks is in a range from about 50 nm to about 500 nm, the first portion is parallel to each other and arranged uniformly on the conductive substrate to maintain an appearance of the carbon nanotube array, and adjacent two of second portions of the plurality of carbon nanotube segments are spaced from each other by a distance greater than a distance between corresponding two of first portions.

7. The emitter as claimed in claim 6, wherein at least one projecting carbon nanotube is taller than and projects over other carbon nanotubes in each of the taper-shaped emitting peaks.

8. The emitter as claimed in claim 7, wherein in each of the taper shaped emitting peak, the other carbon nanotubes are surround the at least one projecting carbon nanotube.

* * * * *